US011565191B2

(12) United States Patent
Williams

(10) Patent No.: US 11,565,191 B2
(45) Date of Patent: Jan. 31, 2023

(54) LOW-COST JOINTED TOY FIGURE AND ITS ASSOCIATED METHOD OF MANUFACTURE

(71) Applicant: Plan C, LLC, Bend, OR (US)

(72) Inventor: Kevin Williams, Sprakers, NY (US)

(73) Assignee: Plan C, LLC, Bend, OR (US)

( * ) Notice: Subject to any disclaimer, the term of this patent is extended or adjusted under 35 U.S.C. 154(b) by 75 days.

(21) Appl. No.: 17/074,613

(22) Filed: Oct. 19, 2020

(65) Prior Publication Data

US 2022/0118372 A1 Apr. 21, 2022

(51) Int. Cl.

| | |
|---|---|
| ***A63H 3/00*** | (2006.01) |
| ***A63H 3/46*** | (2006.01) |
| ***A63H 9/00*** | (2006.01) |
| ***A63H 3/10*** | (2006.01) |

(52) U.S. Cl.

CPC ..... *A63H 3/46* (2013.01); *A63H 3/10* (2013.01); *A63H 9/00* (2013.01)

(58) Field of Classification Search

CPC ... A63H 3/00; A63H 3/04; A63H 3/46; A63H 9/00

See application file for complete search history.

(56) References Cited

U.S. PATENT DOCUMENTS

| | | | | | |
|---|---|---|---|---|---|
| 1,270,781 | A | * | 7/1918 | Cabana | A63H 3/46 446/381 |
| 1,359,030 | A | * | 11/1920 | Cabana | A63H 3/46 446/381 |
| 1,595,203 | A | | 8/1926 | Leathers | |
| 3,624,691 | A | | 11/1971 | Robson et al. | |
| 4,470,784 | A | | 9/1984 | Piotrovsky | |
| 4,571,209 | A | | 2/1986 | Manning et al. | |
| 4,790,789 | A | * | 12/1988 | Mathis | A63H 3/46 403/90 |
| 4,932,919 | A | | 6/1990 | Shapero | |
| 4,954,118 | A | * | 9/1990 | Refabert | A63H 3/46 446/381 |
| 5,017,173 | A | | 5/1991 | Shapero et al. | |
| 5,257,873 | A | * | 11/1993 | Abbat | A63H 3/46 446/376 |

(Continued)

FOREIGN PATENT DOCUMENTS

| | | |
|---|---|---|
| GB | 2193650 | 2/1988 |

*Primary Examiner* — John A Ricci

(74) *Attorney, Agent, or Firm* — LaMorte & Associates PC

(57) ABSTRACT

An articulable toy figure that has multiple body parts joined by ball and socket joints. Frame sections are disposed within the body parts. The frame sections are molded from a first plastic. The ball structures for the joints are molded as part of the frame structures. Additionally, breakaway necks are molded into the frame structures immediately adjacent the ball structures. Body features are over-molded onto frame structures. The body features are molded from a second plastic. The socket structures of the joints are molded as part of the body features. When a body part is first manipulated, the narrowed breakaway neck within the internal frame structure breaks. This frees the ball structure on the frame structures to move within the socket structure of the body feature. This produces a functional ball and socket joint that enables the body parts to be selectively posed.

16 Claims, 8 Drawing Sheets

(56) References Cited

U.S. PATENT DOCUMENTS

| | | | | |
|---|---|---|---|---|
| 6,033,284 | A * | 3/2000 | Rodriguez Ferre | A63H 3/46 446/378 |
| 6,074,270 | A * | 6/2000 | Wilcox | A63H 3/46 446/370 |
| 6,110,002 | A | 8/2000 | Langton | |
| 6,478,653 | B1 * | 11/2002 | Langton | A63H 3/46 446/373 |
| 6,692,332 | B2 * | 2/2004 | Jheow | A63H 3/16 446/383 |
| 6,929,527 | B1 * | 8/2005 | Chan | A63H 3/46 446/376 |
| 6,932,669 | B2 * | 8/2005 | Lee | B29C 45/14467 446/376 |
| 2004/0266315 | A1 | 12/2004 | Ejima et al. | |

* cited by examiner

LOW-COST JOINTED TOY FIGURE AND ITS ASSOCIATED METHOD OF MANUFACTURE

BACKGROUND OF THE INVENTION

1. Field of the Invention

In general, the present invention relates to articulable toy figures. More particularly, the present invention relates to toy figures that have posable internal frames that are over-molded in a flexible material, therein forming the shape of a character.

2. Prior Art Description

Dolls and play figures have existed throughout recorded history. During this long history, dolls and play figures have been produced in countless shapes and sizes and with a variety of features. It is generally understood that the play value of a toy figure increases if the toy figure can be moved into different poses. Accordingly, many dolls and play figures have jointed limbs that enable the limbs to be posed in different orientations.

At first, joints on toy figures where visible external structures and the toy figure required assembly. Assembly complicates the manufacturing process, therein adding significant costs. Assembly issues can be simplified by using various injection molding techniques. Internally jointed skeletons can be produced in an automated fashion. The jointed skeletons can then be internally set within the structure of a doll or toy figure during the molding process. Typically, the jointed skeleton is made of metal parts, such as metal wire. Using metal helps maintain the integrity of the jointed skeleton as the remainder of the doll or toy figure is molded. Prior art toy figures with wire skeletons are exemplified by U.S. Pat. No. 1,595,203 to Leathers and U.S. Pat. No. 3,624,691 to Robson.

There are some problems inherent with using metal skeleton framework within a plastic figure. One problem is that the manufacturing process requires two separate sets of forming tools. One set is used to manufacture the metal skeleton framework. The second set is used to form the plastic around the metal skeleton framework. Often, a significant volume of plastic must be used in order to fully encapsulate the internal metal framework.

Another problem with using a metal skeleton framework is the range of motion available for posing. Skeleton frameworks may enable bending. However, skeleton frameworks typically do not allow for any significant twisting. In order to allow for twisting, simple hinge joints must be replaced with ball and socket joints, such as in U.S. Pat. No. 6,110,002 to Langton.

Making joints from metal and/or making ball and socket joints adds significantly to the cost and labor of making a posable figure. Furthermore, using large volumes of plastic to encapsulate an internal metal framework also significantly adds to the cost of production. It is for these reasons that toy figures intended for low-cost sale do not contain ball and socket joints.

A need therefore exists for a figure design and improved method of manufacture that enables a toy figure to be made with ball and socket joints, without using metal, without using large volumes of plastic and without requiring assembly. These needs are met by the present invention as described and claimed below.

SUMMARY OF THE INVENTION

The present invention is an articulable toy figure that has multiple body parts. The body parts are joined by ball and socket joints that enable the different body parts to move relative one another. The ball and socket joints contain ball structures that are seated within socket structures.

Frame sections are disposed within each of the body parts. The frame sections are molded from a first plastic. The ball structures of the ball and socket joints are molded as part of the frame structures. As such, the ball structures are molded from the first plastic. In addition, narrowed breakaway necks are molded into the frame structures immediately adjacent the ball structures.

Body features are over-molded onto various frame structures. The body features are molded from a second plastic that has a lower molding temperature than that of the first plastic. The socket structures of the ball and socket joints are molded as part of the body features. As such, the socket structures are molded from the second plastic. After the body features are over-molded, the various body parts are complete. When a body part is first manipulated, the narrowed breakaway neck within the internal frame structure breaks. This frees the ball structure on the frame structures to move within the socket structure of the body feature. This produces a functional ball and socket joint that enables the various body parts to be selectively posed.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy figure can be embodied in many ways, only one exemplary embodiment is illustrated for the purposes of explanation and description. The exemplary embodiment is selected in order to set forth one of the best modes contemplated for the invention. The illustrated embodiment, however, is merely exemplary and should not be considered as a limitation when interpreting the scope of the appended claims.

Figure 1:
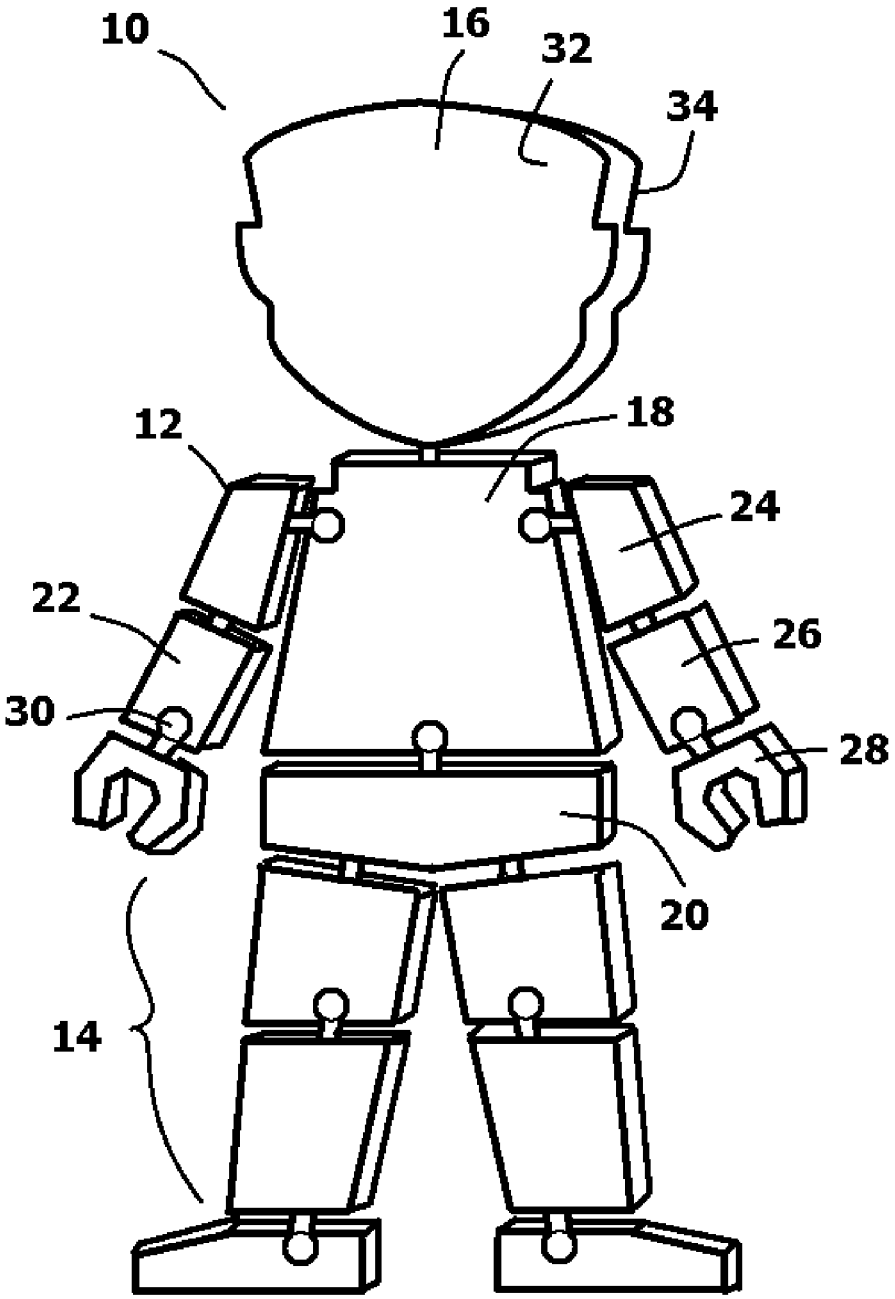
FIG. 1 is a front perspective view of an exemplary embodiment of an articulable toy figure.
Figure 2:
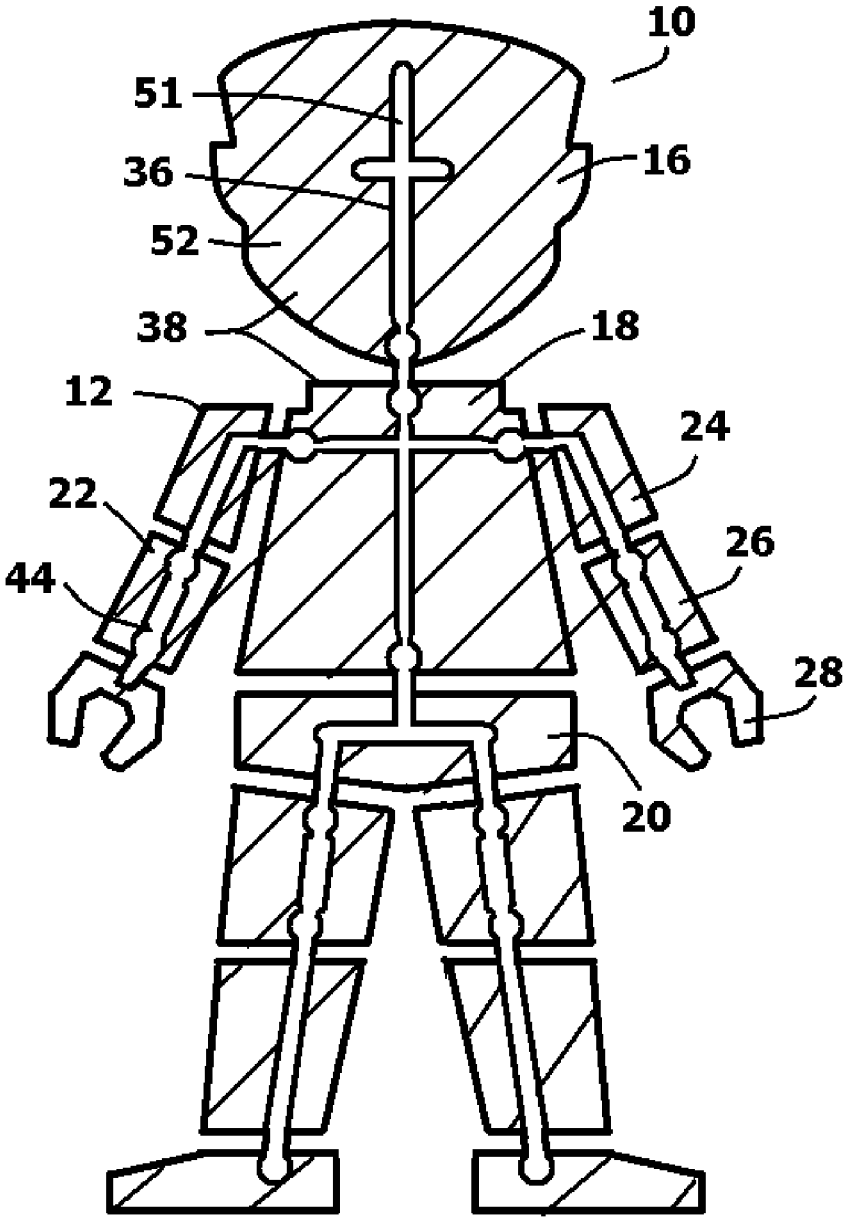
FIG. 2 is a cross-sectional view of the exemplary embodiment of FIG. 1.

Referring to FIG. 1 and FIG. 2, a novel toy FIG. 10 is shown. The toy FIG. 10 has a segmented body 12. The segmented body 12 contains body parts 14 in the form of a head 16, an upper torso 18, a lower torso 20 and limbs 22. The limbs 22 are further segmented and contain a first limb segment 24, a second limb segment 26 and an end segment 28, wherein the end segment 28 is in the form of a hand or foot. As will be explained, the body parts 14 contained within the segmented body 12 are interconnected with ball and socket joints 30. The ball and socket joints 30 enable the various body parts 14 to move in relation to one another.

The toy FIG. 10 is essentially flat. That is, the toy FIG. 10 has a flat front surface 32 and a flat back surface 34 that is parallel to, and a mirror image of, the flat front surface 32. The toy FIG. 10 has a uniform thickness between the flat front surface 32 and the flat back surface 34. The thickness is preferably between 1 mm and 6 mm, therein providing the toy FIG. 10 with a generally flat appearance. The flatness of the toy FIG. 10 enables the toy FIG. 10 to easily fit in a wallet, pocket, or in between the pages of a book.

The segmented body 12 is made from two molded plastics. The segmented body 12 includes an internal frame 36 that is molded from a first plastic 51 and body features 38 that are molded from a second plastic 52. The first plastic 51 of the internal frame 36 is preferably a relatively hard plastic with a high melting point and a flexural modulus of at least 2 Gpa. The second plastic 52 of the body features 38 is preferably a softer plastic, such as an elastomeric plastic, with a molding temperature that is lower than the melting point of the first plastic 51. As will later be explained in more detail, the internal frame 36 is molded first. The second plastic 52 is then over-molded around specific areas of the internal frame 36 to form the body features 38. The results include ball and socket joints 30 that are partially made from the first plastic 51 and partially made from the second plastic 52.

Figure 3:
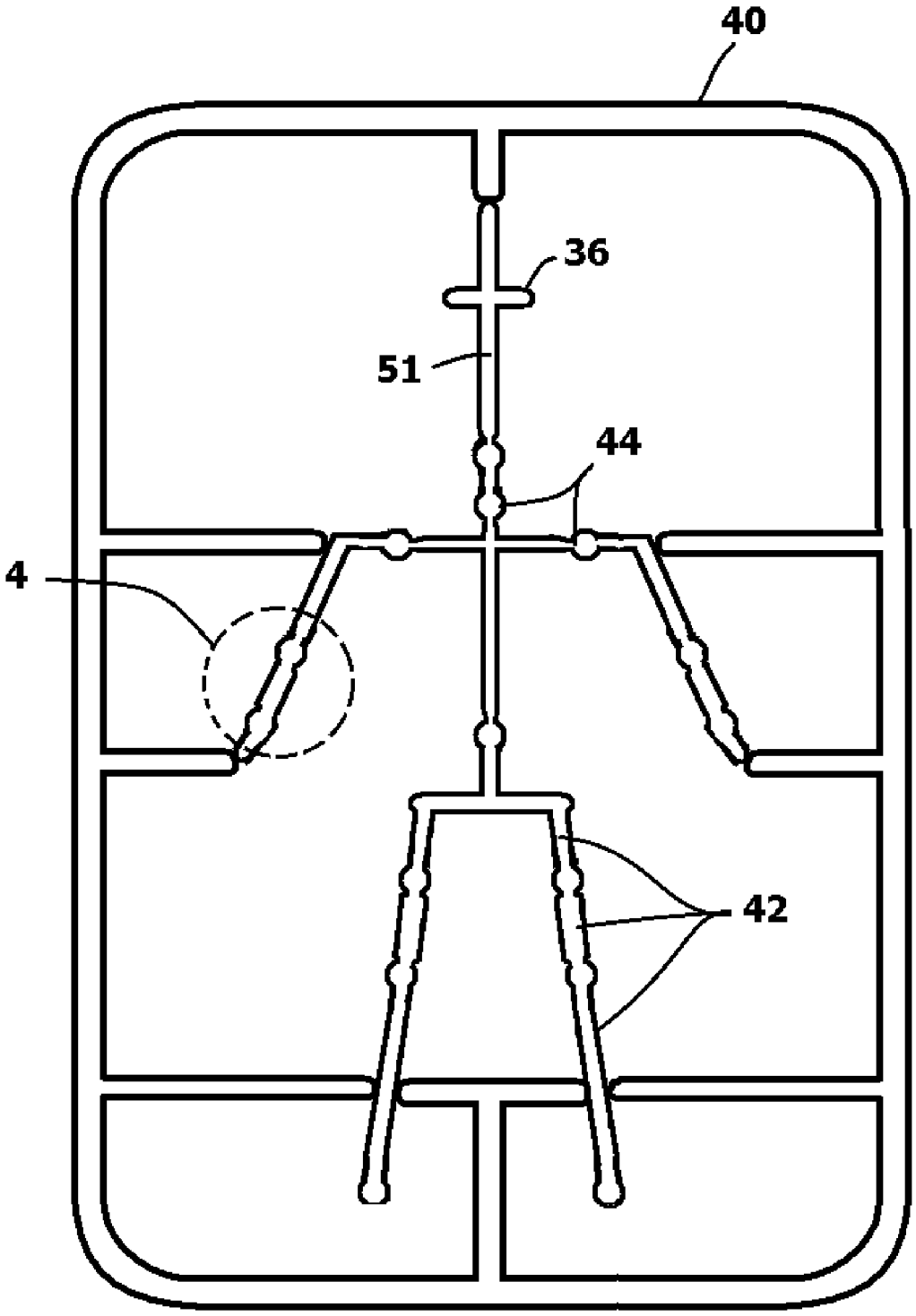
FIG. 3 is front view of an initial molding made from a first plastic.

Referring to FIG. 3 in conjunction with FIG. 2, it can be seen that the internal frame 36 is initially molded within a larger leader structure 40. The leader structure 40 enables the first plastic 51 to flow into and away from the internal frame 36 during an injection molding process. The internal frame 36 contains a plurality of frame sections 42 that are oriented in a common plane. The frame sections 42 are arranged so that there will be one frame section 42 within each of the body parts 14. The frame sections 42 have different shapes depending upon the body part 14 they are intended to support. For instance, the frame sections 42 in the second limb segments 26 are straight. The frame sections 42 in the upper torso 18 and head 16 are cruciforms. Within the internal frame 36, the various frame sections 42 are initially molded as a single piece. However, wherever one frame section 42 meets another, a transition construct 44 is molded.

Figure 4:
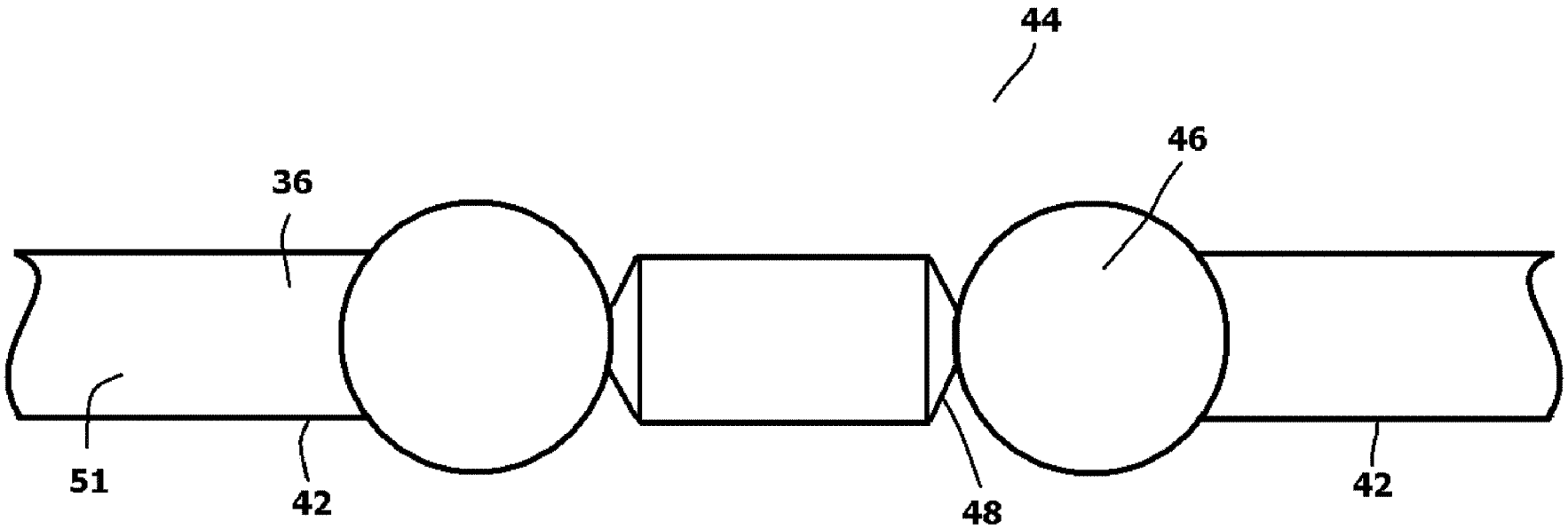
FIG. 4 is an enlarged view of circle 4 indicated in FIG. 3.

Referring to FIG. 4 in conjunction with FIG. 3 and FIG. 2, it can be seen that each transition construct 44 contains an enlarged ball structure 46 and a reduced breakaway neck 48 that is adjacent the enlarged ball structure 46. The enlarged ball structures 46 form the ball half of the various ball and socket joints 30. The reduced breakaway neck 48 makes the first plastic 51 of the internal frame 36 easy to break when manipulated. The reduced breakaway necks 48 also ensure that the internal frames 36 will break at the positions of the reduced breakaway necks 48 when the frame sections 42 are moved relative to one another.

Figure 5:
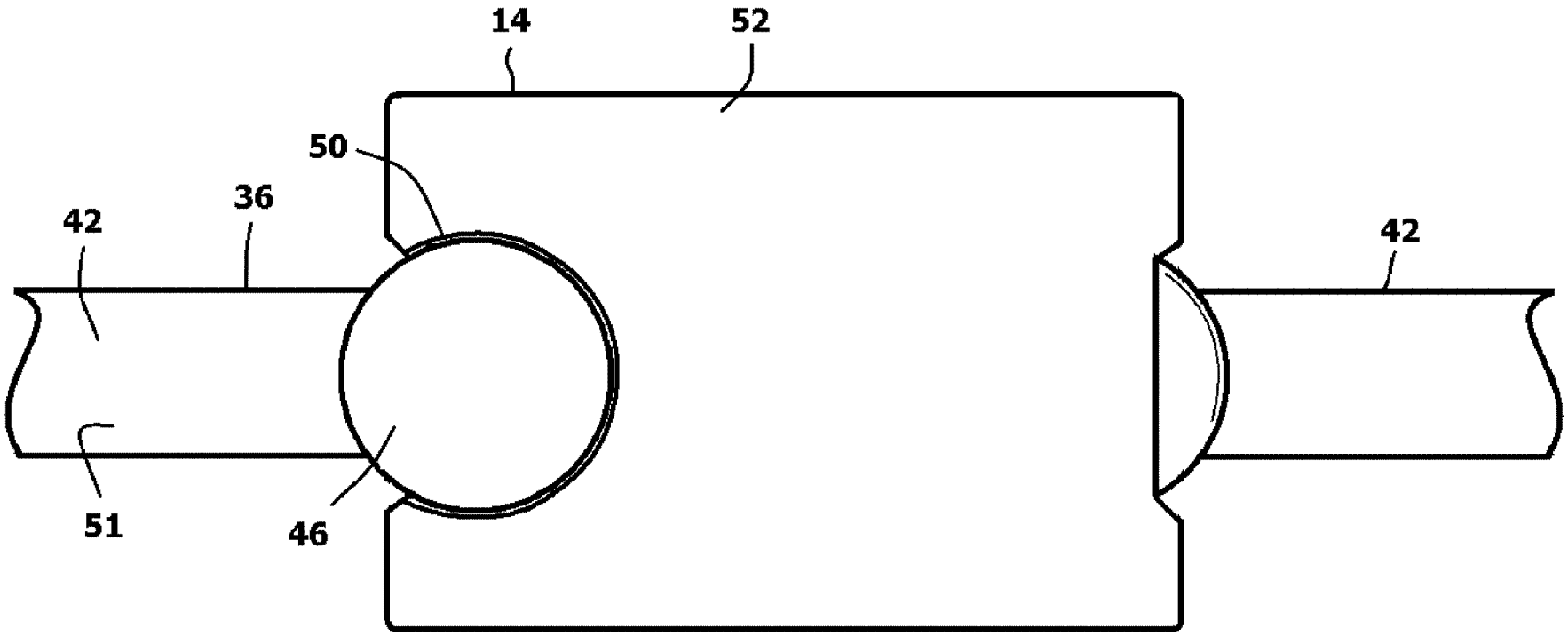
FIG. 5 shows the area of FIG. 4 over-molded in a second plastic.
Figure 6:
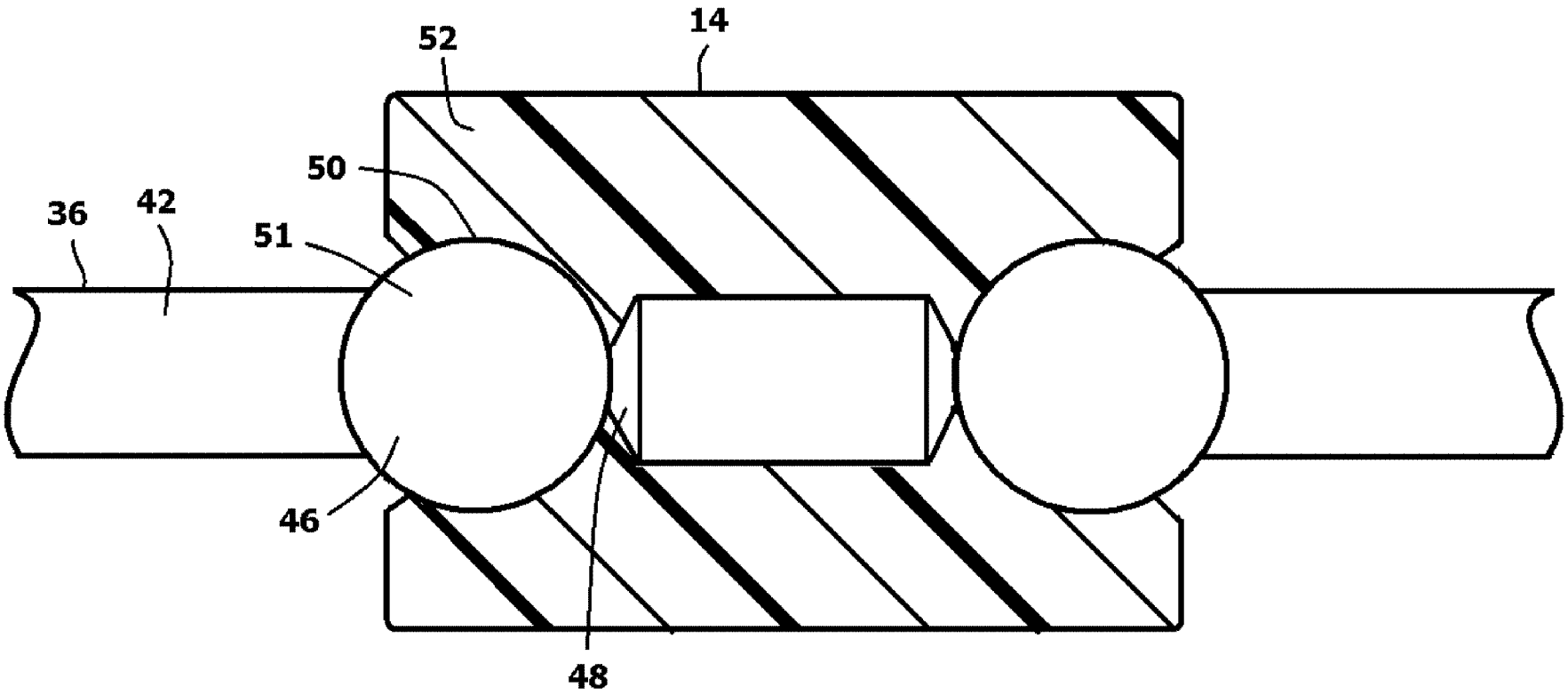
FIG. 6 is a cross-sectional view of the area of FIG. 5.
Figure 7:
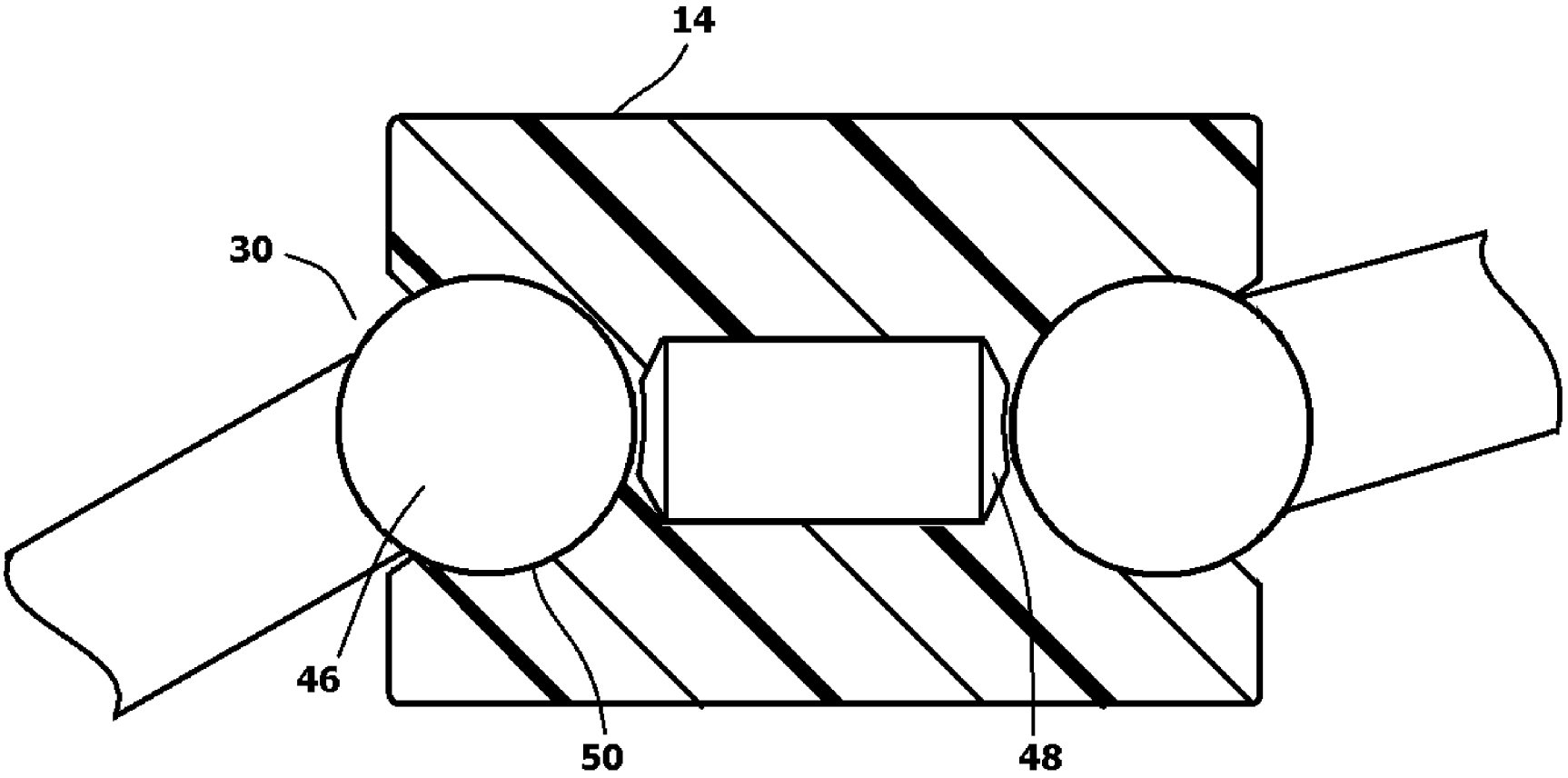
FIG. 7 shows the area of FIG. 6 after manipulation.

Referring to FIG. 5 in conjunction with FIG. 6, FIG. 7 and FIG. 2, it can be seen that areas of the internal frame 36 are over-molded with the second plastic 52 to form the body parts 14. The second plastic 52 is over-molded onto the frame sections 42 of the internal frame 36. The over-molded second plastic 52 is molded in the same plane as the frame sections 42, therein forming the flat front surface 32 and flat back surface 34 of the toy FIG. 10. The second plastic 52 is molded into the various body features 38. In the over-molding process, a socket structure 50 is formed around the enlarged ball structures 46 on the frame sections 42 of the internal frame 36. The socket structure 50 is left open either on the flat front surface 32 or on the flat back surface 34 of the body feature 38 being formed. The result is that the socket structures of the over-molded body features 38 form the socket half of the ball and socket joints 30, while the enlarged ball structures 46 serve as the ball half of the ball and socket joints 30.

Referring to FIG. 7 in conjunction with FIG. 2, it can be seen that once a first body part 14 of the toy FIG. 10 is moved in relation to an adjacent body part, any reduced breakaway neck 48 within that first body part will break. This separates the reduced breakaway neck 48 from the enlarged ball structure 46. Once separated, the enlarged ball structure 46 is free to rotate within the socket structure 50 formed around the enlarged ball structure 46. As a result, the enlarged ball structure 46 of the first plastic 51 can rotate in the socket structure 50 of the second plastic 52, therein forming a functional ball and socket joint 30. The ball and socket joints 30 enable the various body parts 14 of the toy FIG. 10 to move and rotate in relation to the other body parts 14. This enables the toy FIG. 10 to be selectively posed into various configurations.

Figure 8:
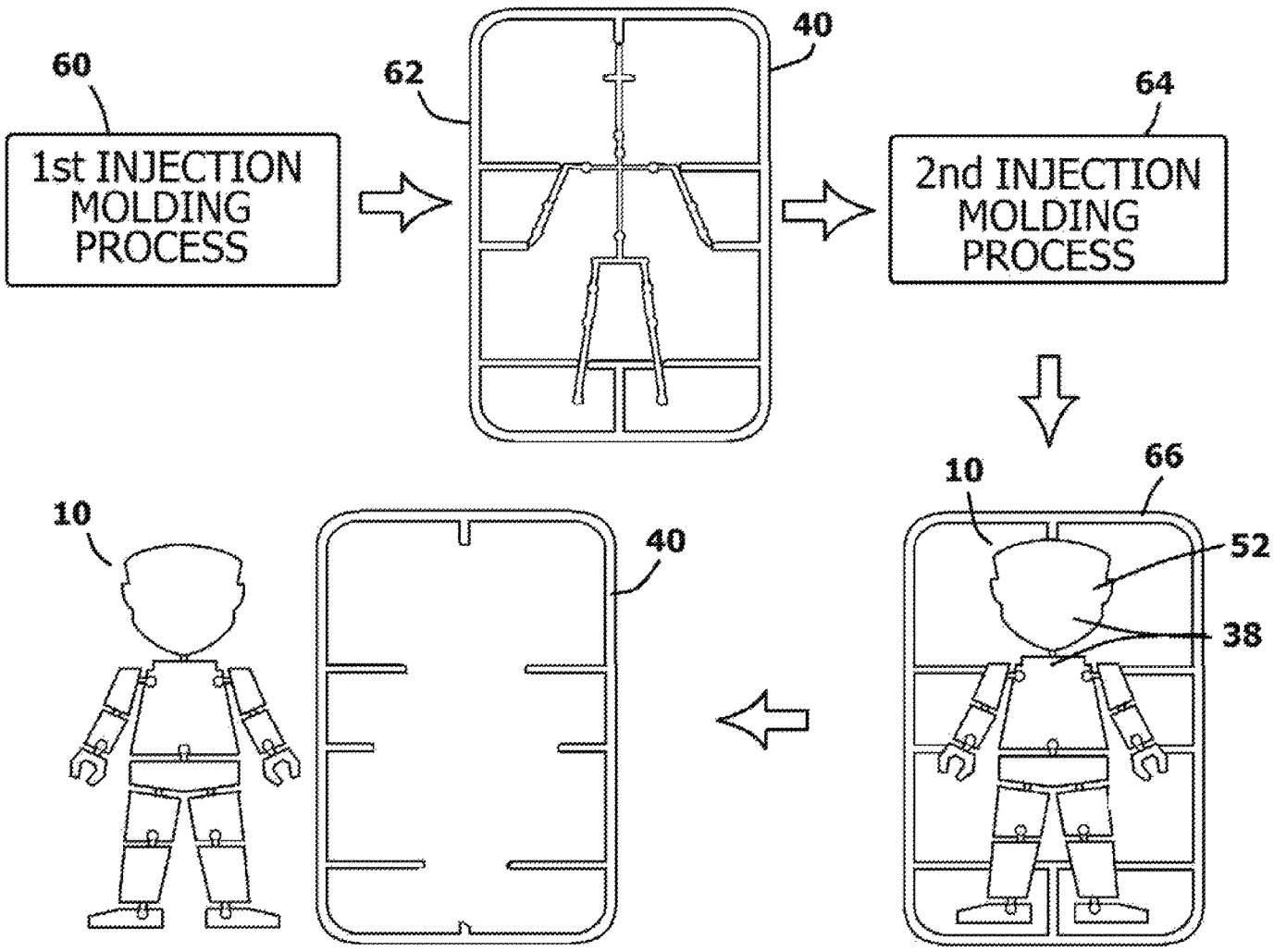
FIG. 8 illustrates a method of manufacture for the toy figure of FIG. 1.

Referring to FIG. 8, in conjunction with FIG. 2 and FIG. 6, the method of manufacturing the toy FIG. 10 can now be explained. An initial molding 62 is made using a first injection molding process 60. The initial molding 62 includes the internal frame 36 and the leader structure 40. The internal frame 36 and leader structure 40 are integrally molded as a single piece from the first plastic 51. The internal frame 36 contains the various frame sections 42 and the transition constructs 44 between the various frame sections 42.

Sections of the internal frame 36 are then over-molded in a second injection molding process 64. This is accomplished by placing the initial molding 62 into a secondary mold and injecting the second plastic 52 around areas of the internal frame 36. The second plastic 52 is molded into the various body features 38 to complete the toy FIG. 10. This produces a second molding 66, wherein the toy FIG. 10 is still surrounded by the leader structure 40. The toy FIG. 10 can be packaged with the leader structure 40 to help maintain the structural integrity of the toy FIG. 10 during retail display or shipping. Once purchased, the toy FIG. 10 can be selectively detached from the leader structure 40. The toy FIG. 10 can then be posed. As the toy FIG. 10 is manipulated to be posed, the reduced breakaway necks 48 within the internal frame 36 become stressed and break, therein enabling the ball and socket joints 30 to operate. Once the ball and socket joints 30 become functional, body parts 14 on opposite sides of a ball and socket joint 30 can be moved relative to each other. Furthermore, the body parts 14 can be rotated out of the initial plane of the second molding 66.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. An articulable toy figure, comprising:

a segmented body containing multiple body parts joined by ball and socket joints, wherein each of said body parts contains a frame section molded from a first plastic and a body feature over-molded in a different second plastic, wherein said ball and socket joints that have ball structures molded in said first plastic as part of said frame section and socket structures molded in said second plastic as part of said body feature; and wherein said frame section, in at least some of said body parts, contains reduced breakaway sections that enable said frame section to break when at least some of said body parts are moved in relation to one another.

2. The toy figure according to claim 1, wherein said reduced breakaway sections are molded in said first plastic adjacent said ball structures of said ball and socket joints.

3. The toy figure according to claim 1, wherein each of said body parts has a flat front surface and a flat back surface.

4. The toy figure according to claim 3, wherein said flat back surface has a mirrored shape of said flat front surface.

5. The toy figure according to claim 3, wherein each said body feature has a uniform thickness between said flat front surface and said flat back surface.

6. An articulable toy figure, comprising:

multiple body parts joined by ball and socket joints, wherein said ball and socket joints contain ball structures seated within socket structures;

frame sections disposed within said body parts, wherein said frame sections are molded from a first plastic, and wherein said ball structures are molded as part of said frame sections;

body features covering at least some of said frame sections, wherein said body features are over-molded onto said frame sections in a second plastic, and wherein said socket structures are molded as part of said body features, and wherein at least some of said frame sections contain reduced breakaway sections that enable said frame sections to break when at least some of said body parts are moved in relation to one another.

7. The toy figure according to claim 6, wherein said reduced breakaway sections are molded in said first plastic adjacent to said ball structures of said ball and socket joints.

8. The toy figure according to claim 6, wherein each of said body parts has a flat front surface and a flat back surface.

9. The toy figure according to claim 8, wherein said flat back surface has a mirrored shape of said flat front surface.

10. The toy figure according to claim 9, wherein each of said body features has a uniform thickness between said flat front surface and said flat back surface.

11. The toy figure according to claim 6, wherein said second plastic is elastomeric.

12. A method of manufacturing an articulable toy figure, comprising:

molding a frame from a first plastic that contains frame sections, wherein at least some of said frame sections include ball structures and reduced breakaway sections that enable said frame sections to break when said frame sections are moved in relation to one another over-molding body parts around at least some of said frame sections in a second plastic, wherein at least some of said body parts include socket structures that partially surround said ball structures on said frame sections, wherein said ball structures and said socket structures form ball and socket joints that enable relative movement of said frame sections and said body parts.

13. The method according to claim 12, wherein said reduced breakaway sections are molded in said first plastic adjacent to said ball structures.

14. The method according to claim 13, wherein over-molding body parts around at least some of said frame sections includes molding each of said body parts with a flat front surface and a flat back surface.

15. The method according to claim 14, wherein said flat back surface has a mirrored shape of said flat front surface.

16. The method according to claim 14, wherein each of said body features have a uniform thickness between said flat front surface and said flat back surface.

* * * * *